US006089874A

United States Patent [19]

Kroulik et al.

[11] Patent Number: 6,089,874

[45] Date of Patent: Jul. 18, 2000

[54] ROTATABLE ELECTRICAL CONNECTOR

[75] Inventors: Erwin K. Kroulik, Edmore; Richard J. Balaguer, Ortonville; Timothy J. Jones, Big Rapids, all of Mich.

[73] Assignee: Flex-Cable, Inc., Morley, Mich.

[21] Appl. No.: 09/205,044

[22] Filed: Dec. 4, 1998

[51] Int. Cl.[7] ..... H01R 39/00

[52] U.S. Cl. ..... 439/11; 439/655

[58] Field of Search ..... 439/11, 164, 655

[56] References Cited

U.S. PATENT DOCUMENTS 5,460,535 10/1995 Bolen ..... 439/164

5,735,480 4/1998 Arai et al. ..... 439/164

5,762,508 6/1998 Tanaka et al. ..... 439/164

*Primary Examiner*—Gary Paumen

*Attorney, Agent, or Firm*—Taylor & Aust, P.C.

[57] ABSTRACT

An electrical connector is disclosed that allows for relative twisting movement between cables or cords coupled thereto by absorbing any such twisting movement in shunts disposed internal to the connector. The shunts as well provide the communication between oppositely disposed prongs that extend from the connector housing in order to provide electrical continuity. In one form, the shunts coil around themselves internal to the connector housing as the shunts connect one side's prong to the other.

14 Claims, 2 Drawing Sheets

ROTATABLE ELECTRICAL CONNECTOR

BACKGROUND OF THE INVENTION

1. Field of the Invention

The present invention relates to electrical connectors and, more specifically, to an electrical coupling especially for use in electrical cables.

2. Description of the Related Art

All electrical power tools and machinery rely on electricity which is supplied to the tool or machine via a power cable or cord. Items such as portable power tools utilize a power cord attached to the tool and have a plug on the other end. Electric machines likewise are coupled to a source of electric power. In many situations, the power cable or cord is subject to wear and tear in the same manner as the machine or tool itself. However, the supply of power to the machine or tool is a main concern.

In industrial applications that utilize robotics, robot arms carry a variety of machine tools such as welders and the like that allow the remote or robotic operation of the machine tool in order to perform work on a workpiece or product. In addition to power being supplied to the robot via power cables or lines, power must be supplied to the machine tool that is carried by the robot arm. Power to the machine tool is supplied via power cables that are usually clamped or retained in some manner to the robot arm.

Since the robot arm twists, turns, rotates, and bends in various ways in order to accomplish its task, the power cord or cable carried by the robot arm is subject to stress. As the robot arm moves so must the cable. As the power cable is stressed its integrity is compromised. Such problems as breakdown of the inner wires can create incontinuity. It would be desirable if there could be a reduction in stress on a power cable caused by twisting of the power cable.

Even in manual use of power tools such as welders, including MIG and TIG welders, it would be desirable if the cable coupled to the welder would rotate or twist more than what is allowed by the static power cord and internal parts of the cable.

What is needed is an electrical cable coupling that will allow rotation or twisting between cables connected thereto.

SUMMARY OF THE INVENTION

The present invention provides an electrical connector or coupling that accommodates relative twisting motion between connected cables while maintaining electrical continuity therebetween.

The connector may be fashioned for single conductor cables or for dual polarity (kickless) cables.

The invention comprises, in one form thereof, a housing structure within which a terminal assembly/structure is rotatably disposed. The terminal assembly comprises first and second terminals for respective connection to two power cables, and shunts that electrically couple the first and second terminals, the shunts being adapted to twist or torque relative to the terminals. In this manner, the cables that are connected to respective terminals may twist and untwist relative to each other as the shunts twist and untwist in response to the cable twisting.

Preferably, the shunts are naturally biased in an untwisted position within the housing and are fabricated from ¼" thick, insulated, 0.005" metal. Also, the shunts are preferably bolted to the prongs such that there is no movement between the prong and shunt which could cause resistance values to change.

In one form thereof, the present connector is a male-to-male connector wherein the terminal assembly includes a first pair of prongs defining a first coupling and a second pair of prongs defining a second coupling. The first pair of prongs extend from a first side of the connector for coupling to a first power cable having a mating connection. The second pair of prongs extend from a second side of the connector for coupling to a second power cable having a mating connection. The first and second pairs of prongs extend from respective walls rotatably retained within the housing with each prong coupled to a coiled shunt internal to the housing. The terminal assembly further comprises first and second rails to which are coupled an end of each shunt of each prong. The rails and associated coupled shunts are situated such that one prong of the first pair of prongs is electrically coupled to one prong of the second pair of prongs, with the other prong of the first pair of prongs being electrically coupled to the other prong of the second pair of prongs. Each pair of prongs and associated shunts may be considered a prong assembly.

In another form thereof, the terminal assembly has a first prong that extends from a first wall on one side of the connector housing and a second prong that extends from a second wall on another side of the connector housing. The first prong is coupled to a first a shunt that is in turn coupled to a rail internal to the housing, while the second prong is coupled to a second shunt that is in turn coupled to the rail, each shunt being coiled internal to the housing. The first and second walls each being rotatably retained by the housing. In this manner, the prong assemblies are rotatable relative to each other such that as each cable twists, the respective prong assembly likewise twists.

In another form thereof, the present coupling may be water cooled. In a water cooled embodiment, each terminal would have a housing or portion that allows for the introduction of water. Such a connector would be sealed on the inside.

It is also possible to integrate the present coupling into the power cable itself.

An advantage of the present invention is that it provides reduced fatigue on a power tool or machine system.

Another advantage is extended cable life due to less twisting thereof.

Yet another advantage is the reduction of abrasion of machine parts due to cable twist.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
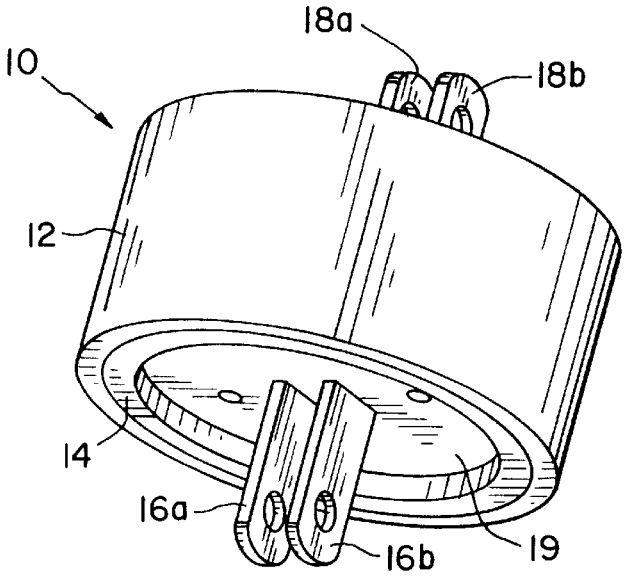
FIG. 1 is a perspective view of an embodiment of the present connector.
Figure 2:
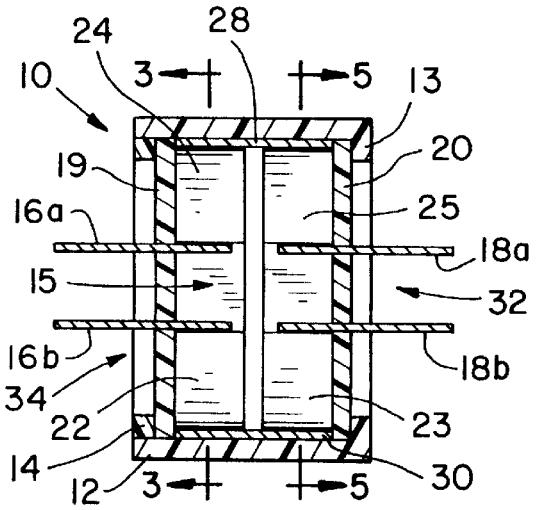
FIG. 2 is a sectional view of the present connector showing the internal shunts.

Referring now to the drawings and particularly to FIGS. 1 and 2, there is shown an embodiment of the present electric connector or coupling generally designated 10. Electric connector 10 has a housing or shell 12 that defines an inner cavity 15. Housing 12 may be made of a plastic or the like suitable for electrical plug applications, and is preferably cylindrical in shape.

As best seen in FIG. 2, housing 12 has an annular ledge or lip 13 that extends a short distance radially inwardly of the housing surface to define an annular opening 32 and that retains a disc-shaped wall 20 on an inner surface thereof such that wall 20 is rotatable relative to housing 12. Two prongs 18*a* and 18*b* originate within cavity 15 and extend through wall 20, thus forming a coupling or connection point for a first electrical cable (not shown). Since wall 20 is rotatable and carries prongs 18*a* and 18*b*, prongs 18*a* and 18*b* necessarily rotate along with wall 20, or as prongs 18*a* and 18*b* are torqued into rotation, wall 20 is likewise rotated.

Situated within cavity 15 is a first electrically conducting rail or bar 28 and a second electrically conducting rail or bar 30. Preferably, rails 28 and 30 are on opposite sides of each other adjacent an inner surface of housing 12. Housing 12 also has an annular opening 34 opposite annular opening 32. Disposed within annular opening 34 is a second a disc-shaped wall 19 that is rotatable relative to housing 12. Rails 28 and 30 axially extend from wall 20 to a point within housing 12 such that ends thereof provide a stop to retain wall 19 an axial distance from an end of housing 12. An annular retaining ring 14 fits within housing 12 adjacent wall 19. Two prongs 16*a* and 16*b* originate within cavity 15 and extend through wall 19, thus forming a coupling or connection point for a second electrical cable (not shown). Since wall 19 is rotatable and carries prongs 16*a* and 16*b*, prongs 16*a* and 16*b* necessarily rotate along with wall 19, or as prongs 16*a* and 16*b* are torqued into rotation, wall 19 is likewise rotated.

Prongs 16*a*, 16*b*, 18*a*, and 18*b* are made from an electrically conducting material such as metal or the like generally used for electrical cable application and are sized accordingly to be accommodated in the receiving plug or connector of the power cable to be attached thereto.

Electrically coupled to prong 18*a* at a connection point within cavity 15 is a shunt 25 that coils around and is electrically coupled to rail 30. Electrically coupled to prong 18*b* at a connection point within cavity 15 is a shunt 23 that coils around and is electrically coupled to rail 28. Electrically coupled to prong 16*a* at a connection point within cavity 15 is a shunt 24 that coils around and is electrically coupled to rail 30. Electrically coupled to prong 16*b* at a connection point within cavity 15 is a shunt 22 that coils around and is electrically coupled to rail 28. Preferably, the shunts are coupled to the prongs via bolts, however other methods may be used. In this manner, prong 18a is electrically coupled to prong 16*a* and prong 18*b* is electrically coupled to prong 16*b*.

Shunts 22, 23, 24, and 25 wrap or coil around within cavity 15 such that as the prongs are torqued or twisted by action of the torquing or twisting of the connected cables (not shown), the respective shunts flex, twist or torque as well to absorb the twisting motion of the cables. In one form, the shunts may be coils, springs, or strips of ¼" metal, and preferably are coils of metal wire, strips, or springs, and are attached by bolting, welding, or the like to the respective prong and rail, providing electrical continuity or conductivity.

At this point, it should be understood that the present connector may have only one prong at each end thereof rather than pairs. In this case, there would be only two shunts within the internal cavity of the connector electrically coupled to each other via a single rail.

Figure 3:
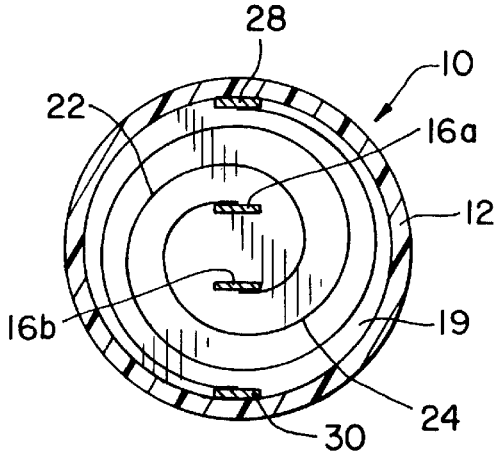
FIG. 3 is a view taken along line 3—3 of FIG. 2 illustrating the shunts associated with one pair of prongs in an untwisted position.
Figure 4:
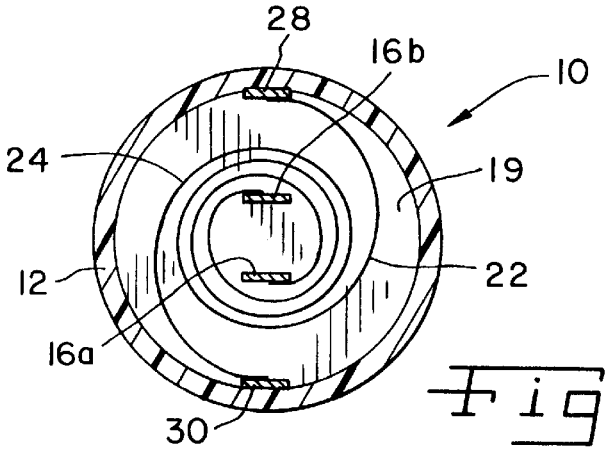
FIG. 4 is the view of FIG. 3 illustrating the shunts in an untwisted position.

Additionally referring now to FIGS. 3–6, the operation of the present connector will be described. FIG. 3 depicts prongs 16*a* and 16*b* and respectively associated shunts 24 and 22 in an unbiased or untwisted position. Shunt 22 extends from prong 16*b* to rail 28 to provide electrical continuity therebetween, while shunt 24 extends from prong 16*a* to rail 30 to provide electrical continuity therebetween. In FIG. 4, as prongs 16*a* and 16*b* are twisted or rotated by a connected cable (not shown) wall 19 likewise rotates. This causes shunts 22 and 24 to coil or compress, thereby absorbing the twisting motion of the connected cable (not shown). Again, shunts 22 and 24 are naturally biased in an untwisted position so as to spring back when the twisting stops.

Figure 5:
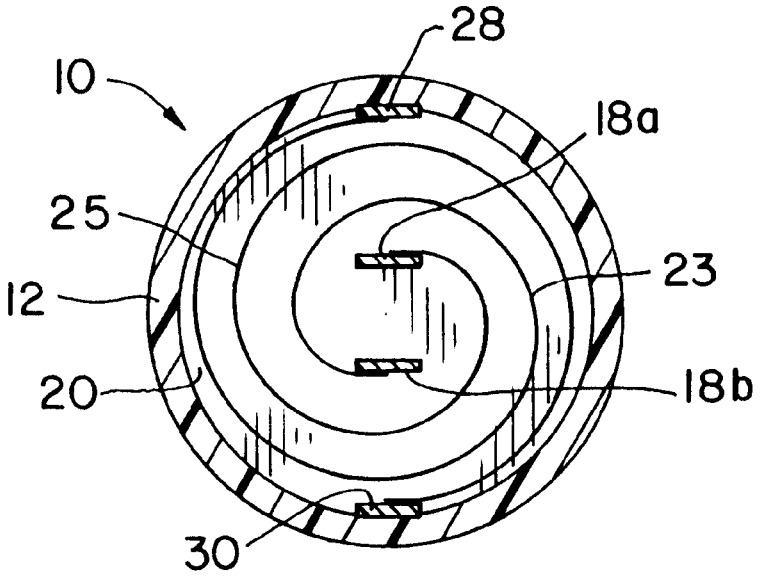
FIG. 5 is a view taken along line 5—5 of FIG. 2 illustrating the shunts associated with another pair of prongs in an untwisted position.
Figure 6:
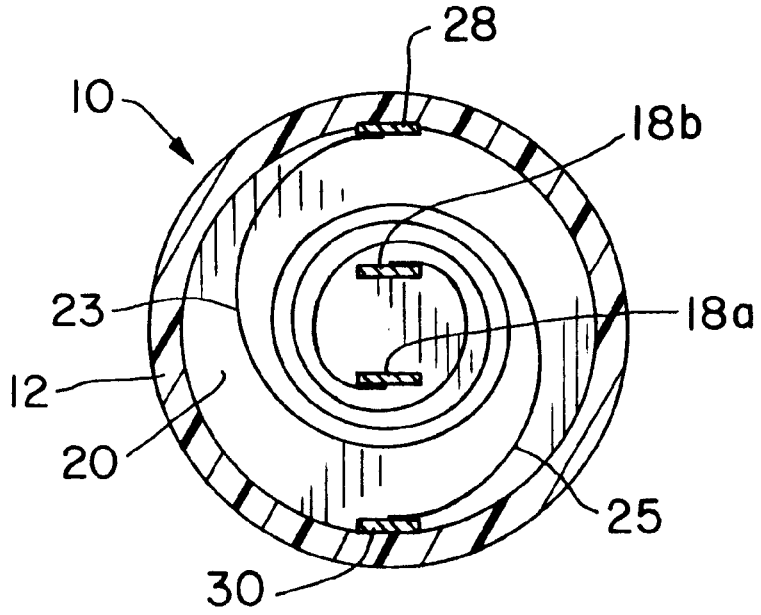
FIG. 6 is the view of FIG. 5 illustrating the shunts in a twisted position.

FIG. 5 depicts prongs 18*a* and 18*b* and respectively associated shunts 25 and 23 in an unbiased or untwisted position. Shunt 23 extends from prong 18*b* to rail 28 to provide electrical continuity therebetween, while shunt 25 extends from prong 18*a* to rail 30 to provide electrical continuity therebetween. In FIG. 6, as prongs 18*a* and 18*b* are twisted or rotated by a connected cable (not shown) wall 20 likewise rotates. This causes shunts 23 and 25 to coil or compress, thereby absorbing the twisting motion of the connected cable (not shown). Again, shunts 23 and 25 are naturally biased in an untwisted position so as to spring back when the twisting stops.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical connector for coupling a first cable to a second cable and allowing relative rotation therebetween, the electrical connector comprising:

a housing;

a first electrical terminal extending from one side of said housing and adapted to couple to the first cable;

a second electrical terminal extending from another side of said housing and adapted to couple to the second cable; and a coiled shunt assembly internal to said housing and electrically coupling said first electrical terminal to said second electrical terminal.

2. The electrical connector of claim 1, wherein said first electrical terminal comprises a first pair of prongs embedded in and extending through a first wall rotatably retained by said housing, and said second electrical terminal comprises a second pair of prongs embedded in and extending through a second wall rotatably retained by said housing, and said coiled shunt assembly comprises a first coiled shunt electrically coupled at one end to one prong of said first pair of prongs and at another end to a first rail internal to said housing, a second coiled shunt electrically coupled at one end to another prong of said first pair of prongs and at another end to a second rail internal to said housing, a third coiled shunt electrically coupled at one end to one prong of said second pair of prongs and at another end to said first rail, and a fourth coiled shunt electrically coupled at one end to another prong of said second pair of prongs and at another end to said second rail.

3. The electrical connector of claim 2, wherein said first and second coiled shunts are naturally unbiased.

4. The electrical connector of claim 2, wherein said shunts are coiled strips of metal.

5. The electrical connector of claim 1, wherein said first electrical terminal comprises a first prong embedded in and extending through a first wall rotatably retained by said housing, said second electrical terminal comprises a second prong embedded in and extending through a second wall rotatably retained by said housing, and said coiled shunt assembly comprises a first coiled shunt electrically coupled at one end to said first prong and at another end to a rail internal to said housing, and a second coiled shunt electrically coupled at one end to said second prong and at another end to said rail.

6. An electrical connector for coupling a first electrical cable to a second electrical cable, said electrical connector comprising:

a cylindrical, electrically insulating housing defining an internal cavity with first and second open ends;

a first wall rotatably retained by said housing at said one end;

a second wall rotatably retained by said housing at said second end;

a first terminal structure carried by said first wall;

a second terminal structure carried by said second wall; and a shunt assembly disposed in said cavity and electrically coupling said first terminal structure to said second terminal structure, said shunt assembly being elastically twistable, whereby relative twisting between the first and second cables is absorbed.

7. The electrical connector of claim 6, wherein said housing includes an annular ledge on said first end with said first wall being axially retained thereby, and an annular retaining ring on said second end with said second wall being axially retained thereby.

8. The electrical connector of claim 6, wherein said first terminal structure comprises a first prong embedded in and extending through said first wall, said second terminal structure comprises a second prong embedded in and extending through said second wall, and said shunt assembly comprises a first coiled shunt electrically coupled at one end to said first prong and at another end to a rail internal to said housing, and a second coiled shunt electrically coupled at one end to said second prong and at another end to said rail.

9. The electrical connector of claim 7, wherein said first and second coiled shunts are ¼" strips of an electrical conductor.

10. The electrical connector of claim 6, wherein first terminal structure comprises a first pair of prongs embedded in and extending through said first wall, and said second terminal structure comprises a second pair of prongs embedded in and extending through said second wall, and said shunt assembly comprises a first coiled shunt electrically coupled at one end to one prong of said first pair of prongs and at another end to a first rail internal to said housing, a second coiled shunt electrically coupled at one end to another prong of said first pair of prongs and at another end to a second rail internal to said housing, a third coiled shunt electrically coupled at one end to one prong of said second pair of prongs and at another end to said first rail, and a fourth coiled shunt electrically coupled at one end to another prong of said second pair of prongs and at another end to said second rail.

11. The electrical connector of claim 7, wherein said coiled shunts are ¼" strips of an electrical conductor.

12. An electrical coupling that allows relative rotational movement between a first end thereof adapted to couple to a first cable and a second end thereof adapted to couple to a second cable, the electrical coupling comprising:

a cylindrical, non-electrically conducting housing defining an internal cavity, said housing having a radially inwardly extending ledge on the first end and defining a first opening, and a second opening on the second end;

a first disc-shaped wall rotatably retained within said cavity by said ledge;

a first rail disposed within said cavity and extending from an inner surface of said first disc-shaped wall toward said second opening and terminating at a point internal to said housing;

a second rail disposed within said cavity and extending form an inner surface of said first disc-shaped wall toward said second opening and terminating at a point internal to said housing;

a second disc-shaped wall disposed at said second end and abutting ends of said first and second rails, said second discshaped wall rotatably retained by said housing;

an annular retaining ring disposed at said second opening and adjacent said second disc-shaped wall;

a first pair of prongs extending from said cavity through said first wall and exterior of said outer housing;

a second pair of prongs extending from said cavity through said second wall and exterior of said housing;

a first shunt of a coiled, naturally unbiased electrical conductor disposed in said cavity and electrically coupling one prong of said first pair of prongs to said first rail;

a second shunt of a coiled, naturally unbiased electrical conductor disposed in said cavity and electrically coupling another prong of said first pair of prongs to said second rail;

a third shunt of a coiled, naturally unbiased electrical conductor disposed in said cavity and electrically coupling one prong of said second pair of prongs to said first rail;

a fourth shunt of a coiled, naturally unbiased electrical conductor disposed in said cavity and electrically coupling another prong of said second pair of prongs to said second rail.

13. The electrical coupling of claim 7, wherein said shunts are fabricated from ¼" strip metal.

14. The electrical coupling of claim 7, wherein said housing is fabricated from plastic.

* * * * *